US006929413B2

(12) United States Patent
Schofield

(10) Patent No.: US 6,929,413 B2
(45) Date of Patent: Aug. 16, 2005

(54) PRINTER DRIVER LOG SECURITY VERIFICATION FOR IDENTIFICATION CARDS

(75) Inventor: Harry Schofield, Narragansett, RI (US)

(73) Assignee: Zebra Atlantek, Inc., Wakefield, RI (US)

( * ) Notice: Subject to any disclaimer, the term of this patent is extended or adjusted under 35 U.S.C. 154(b) by 0 days.

(21) Appl. No.: 10/316,563

(22) Filed: Dec. 11, 2002

(65) Prior Publication Data

US 2003/0108373 A1 Jun. 12, 2003

Related U.S. Application Data

(60) Provisional application No. 60/339,179, filed on Dec. 11, 2001.

(51) Int. Cl.[7] ..... B41J 2/00

(52) U.S. Cl. ..... 400/103; 400/104; 235/380; 235/493; 382/115

(58) Field of Search ..... 400/103–107; 340/5.53, 5.6; 382/115–116; 235/380, 432, 493

(56) References Cited

U.S. PATENT DOCUMENTS

| | | | | | |
|---|---|---|---|---|---|
| 3,700,862 | A | | 10/1972 | Snook et al. | 235/61.12 M |
| 4,544,181 | A | | 10/1985 | Maurer et al. | 283/74 |
| 4,663,518 | A | | 5/1987 | Borror et al. | 235/487 |
| 4,869,946 | A | | 9/1989 | Clay | 428/167 |
| 4,929,821 | A | * | 5/1990 | Kocznar et al. | 235/493 |
| 4,998,753 | A | * | 3/1991 | Wichael | 283/82 |
| 5,018,767 | A | | 5/1991 | Wicker | 283/67 |
| 5,122,813 | A | | 6/1992 | Lass et al. | 346/1.1 |
| 5,199,081 | A | | 3/1993 | Saito et al. | 382/2 |
| 5,354,097 | A | | 10/1994 | Tel | 283/72 |
| 5,380,044 | A | | 1/1995 | Aitkens et al. | 283/67 |
| 5,492,370 | A | | 2/1996 | Chatwin et al. | 283/110 |
| 5,505,494 | A | | 4/1996 | Belluci et al. | 283/75 |
| 5,514,860 | A | * | 5/1996 | Berson | 235/468 |
| 5,619,026 | A | | 4/1997 | Chou et al. | 235/462 |
| 5,646,388 | A | | 7/1997 | D'Entremont et al. | 235/380 |
| 5,668,874 | A | | 9/1997 | Kristol et al. | 380/23 |
| 5,688,738 | A | | 11/1997 | Lu | 503/227 |
| 5,735,550 | A | | 4/1998 | Hinkle | 283/108 |
| 5,742,685 | A | * | 4/1998 | Berson et al. | 713/186 |
| 5,760,384 | A | | 6/1998 | Itoh et al. | 235/468 |
| 5,760,386 | A | * | 6/1998 | Ward | 235/493 |
| 5,787,186 | A | | 7/1998 | Schroeder | 382/115 |
| 5,820,971 | A | | 10/1998 | Kaule et al. | 428/209 |
| 5,864,623 | A | * | 1/1999 | Messina et al. | 340/5.86 |
| 5,869,822 | A | | 2/1999 | Meadows, II et al. | 235/380 |
| 5,873,305 | A | | 2/1999 | Dell'olmo | 101/32 |
| 5,880,760 | A | | 3/1999 | Desie et al. | 347/55 |
| 5,883,452 | A | | 3/1999 | Masuda | 235/380 |
| 5,886,334 | A | * | 3/1999 | D'Entremont et al. | 235/380 |
| 5,950,179 | A | | 9/1999 | Buchanan et al. | 705/38 |

(Continued)

*Primary Examiner*—Minh Chau
(74) *Attorney, Agent, or Firm*—Alston & Bird LLP

(57) ABSTRACT

The present invention provides a counterfeit resistant ID card where a printed security feature is applied to the ID card at the issuance location at the time the card is issued. Specifically, the present invention provides for a process of producing an ID card having a unique imbedded security code that is generated and specifically matched to the particular ID card being printed and is applied at the time and place that the card is issued thereby providing a code by which the authenticity of the ID card can be cross verified. Verification is completed by comparing the code on the ID card to the date stamped log of all ID cards printed by the printer at the issuance location. Each entry in the log is encoded with a unique code number that corresponds to the specific print job and more importantly to the specific ID card printed. The present invention provides for the recording of this print log code into a central database to be maintained with the records corresponding to the particular ID card that was printed.

10 Claims, 3 Drawing Sheets

U.S. PATENT DOCUMENTS 5,956,067 A 9/1999 Isono et al. ..... 347/176
5,992,891 A 11/1999 Dyball ..... 283/89
5,994,263 A 11/1999 Ohshima et al. ..... 503/227
5,999,280 A 12/1999 Huang ..... 359/2
6,001,771 A 12/1999 Nakano et al. ..... 503/227
6,010,068 A 1/2000 Bozzo ..... 235/380
6,030,474 A 2/2000 Isono et al. ..... 156/64
6,062,604 A 5/2000 Taylor et al. ..... 283/72
6,089,614 A 7/2000 Howland et al. ..... 283/91
6,110,864 A 8/2000 Lu ..... 503/227
6,119,940 A 9/2000 Klug ..... 235/462.04
6,182,894 B1 2/2001 Hackett et al. ..... 235/380
6,202,933 B1 3/2001 Poore et al. ..... 235/493
6,224,109 B1 * 5/2001 Yang ..... 283/77
6,273,473 B1 8/2001 Taylor et al. ..... 283/72
6,283,188 B1 9/2001 Maynard et al. ..... 156/521
6,294,241 B1 9/2001 Kaule et al. ..... 428/138
6,302,441 B1 10/2001 Kawamuro et al. ..... 283/72
6,318,758 B1 11/2001 Stenzel et al. ..... 283/91

* cited by examiner

PRINTER DRIVER LOG SECURITY VERIFICATION FOR IDENTIFICATION CARDS

CROSS-REFERENCE TO RELATED APPLICATIONS

This application is related to and claims priority from earlier filed provisional patent application No. 60/339,179, filed Dec. 11, 2001.

BACKGROUND OF THE INVENTION

The present invention relates to a process for printing ID cards having a uniquely encoded security authentication component. More specifically, the present invention relates to a process and an ID card formed thereby, where an ID card is created having a unique covert code embedded thereon that can be compared to a code stored in the printer driver log at the location where the card was issued for authentication.

In the prior art, many different forms of ID cards include different types of security microprinting using certain words in the background of the ID. This is also a common feature on US and other foreign currencies and other forms of negotiable paper such as certified checks. In general, the microprinting appears as a kind of watermark on the background of the ID or may be imbedded into a shape contained on the ID card. For example, the Commonwealth of Massachusetts may microprint "Commonwealth of Massachusetts Official Document" across the entire background of the card in a diagonal pattern. Another example is the pattern placed in the background of a certified check that appears as the word void if the check is electronically scanned or copied. Typically, printing of this type is placed on the raw card stock itself when the raw stock is made and shipped to the issuing authority where the personalized information is printed onto the card at the card issuance location. In general, therefore, the microprinting is provided on the blank card stock when the card stock is received at the card issuance location.

The difficulty with applying this type of microprinting as described in the prior art is that it is typically completed using a single pass operation of black ink. While single pass printing is very clear and readable, it is also easily repeatable using most thermal printing technologies available on the market today. As a result, it is easy for counterfeiters to reproduce the microprinting security feature onto raw card stock and then apply the personalized ID information onto the card in a separate operation, thereby circumventing the security of the card. The other issue is that since the micro printing is placed onto the card stock at the point of manufacture, it is possible for a counterfeiter to obtain raw stock as the material passes through various warehousing, shipping and storage operations. In this manner, it is easy for a counterfeiter to create fraudulent ID cards simply by printing the desired personal information onto the raw cards that they obtain.

There is therefore a need for an identification card that includes a microprinted security feature that overcomes the above noted drawbacks while producing a card that is difficult to reproduce at a location other than the card issuance location. Specifically, there is a need for an ID card with a microprinted security feature that is applied at the time and place of the card issuance that cannot be easily reproduced using readily available imaging technology.

BRIEF SUMMARY OF THE INVENTION

In accordance with the present invention, a printed security feature is applied to the ID card at the issuance location at the time the card is issued. The current invention therefore also provides for a unique process of producing an ID card that includes an imbedded security feature, which is applied at the time and place that the card is issued. Specifically, the present invention provides for a process of producing an ID card having a unique imbedded security code that is generated and specifically matched to the particular ID card being printed that is applied at the time and place that the card is issued thereby providing a code by which the authenticity of the ID card can be cross verified.

Card issuance locations typically utilize a high quality three pass thermal color printing process to achieve color images on the ID cards that they issue. These types of machines contain a print driver software component that keeps a date stamped log of all ID cards printed as well as verification of erroneously printed cards. Each entry in the log is encoded with a unique code number that corresponds to the specific print job and more importantly to the specific ID card printed. The present invention provides for the recording of this print log code into a central database to be maintained with the records corresponding to the particular ID card that was printed. In addition, the code information can be placed on the card either as data in a magnetic strip, microprinted text or covert text that is visible only under UV light. Also, the information placed onto the card may be encrypted. When attempting to verify the authenticity of the card, the encoded data contained thereon can be compared to the central database to verify whether it matches the records as contained therein. In application, the present invention for example would provide for each issuing location to have a specific identification code that is printed onto the card that must be matched to that location's records in order to authenticate the card. In another example, when the card is printed, the issuing authority would enter a record into the file system noting the time and place that the card was issued then place this information into the code in the authentication code. If this information does not match the record of the issuing authority, the card is identified as a counterfeit. When this technique is applied, missing, erroneous or altered information on the face of the ID card becomes immediately identifiable, and therefore reduces the ability of counterfeiters to produce fake or altered ID cards.

The benefits to the ID cards and the process used in the present invention are two fold. The first benefit is that the raw cards do not have to be pre-printed with the security microprinting. This saves on processing costs by eliminating an additional handling and printing step while also reducing the possibility that prepared cards may be obtained by counterfeiters. Secondly, since the encoded information contained on each card is unique and specific to the time and place where the card was issued, it becomes more difficult for counterfeiter to reproduce an ID card that would properly include this encoded information. Fake cards become immediately detectable because of a lack of the encoded information or the print code contained thereon would not match the proper code that was expected to be found thereon. In addition, matching the specific printed features to information recorded in the audit log provides yet another higher degree means of authentication.

The process of the present invention therefore includes providing a blank piece of card stock for printing, printing an image onto the ID card, extracting the code that corresponds to the specific print job within the printer, recording the code onto the ID card and recording the code in a central database for later comparison and validation of the ID card. In addition, the present invention includes the ID card end product that is produced using the process of the present invention.

Accordingly, one of the objects of the present invention is the provision of an ID card that includes an integrally printed security feature that is applied at the time and place of card issuance. Another object of the present invention is the production of an ID card that includes a self authenticating security code that can be cross referenced to the issuance records maintained by the issuing authority. A further object of the present invention is the provision of an ID card that is resistant to counterfeiting due to the inclusion of a security code that is related to the time, date and location of issuance of the ID card thereby allowing the authenticity of the card to be verified. Yet a further object of the present invention, is the provision of a process whereby an ID card is produced to include a security code feature that is placed onto the card at the time and place of card issuance that can be cross referenced to the records maintained by the issuing authority for verification of the authenticity of the ID card.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
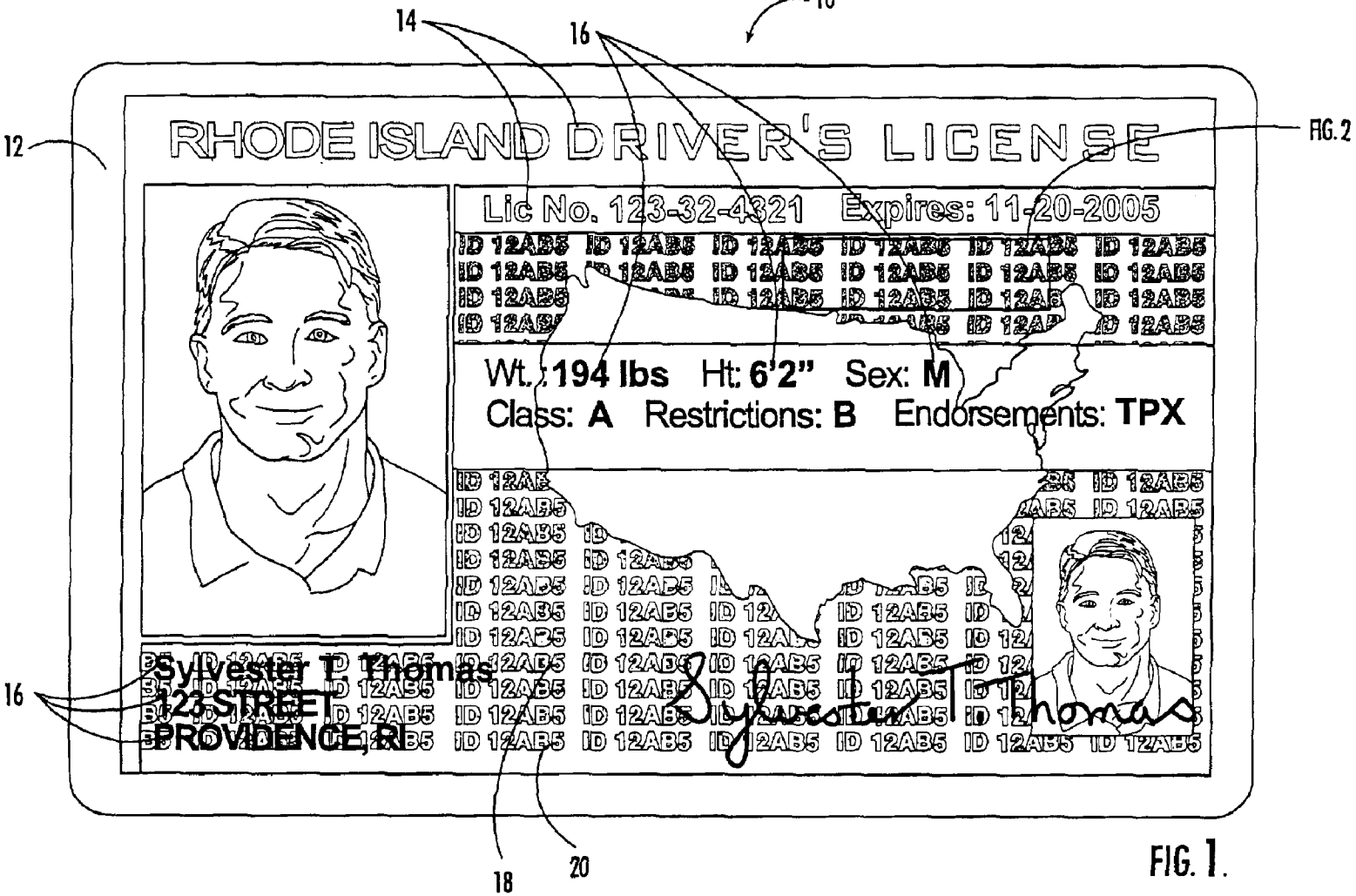
FIG. 1 is front view of the identification card of the present invention.

Referring now to the drawings, the identification card of the present invention is illustrated and generally indicated at 10 in FIG. 1. The ID card 10 has a substrate 12 with indicia printed thereon. Portions of the indicia on the ID card 10 are specially placed and printed to enhance the security and deter the manufacture of counterfeit ID's as will be more fully described below. Further, the present invention provides for a method of manufacturing an ID card 10 that includes security printing that is placed onto the ID card 10 at the time and place of the issuance of the ID card 10 also further deterring the manufacture of counterfeit ID cards 10 as will also be described below. The present invention therefore provides a convenient and economical ID card 10 that is easy to produce while providing enhanced features that deter fraudulent issuance of fake ID cards 10 that has not been previously available in the prior art.

Turning to FIG. 1, the front of the ID card 10 of the present invention is shown. Typically, the card 10 includes a substrate material 12 onto which the relevant card features and information is printed. The substrate 12 may consist of a variety of constructions. In the preferred embodiment, the substrate 12 is a rigid plastic material onto which the indicia are printed directly. Further, the card 10 may include additional features such as a clear overlay (not shown) to further protect the printed indicia. Finally, the card 10 may also include a laminated cover (not shown) over the entire front and back surface of the card 10 to further protect the card 10 and prevent alteration of the front of the card. In addition, the substrate 12 onto which the card is printed is not limited to plastic but may also include paper or cardboard or any other sheet material suitable for printing as is known in the art.

The face of the ID card 10 includes several different types of printed indicia. These indicia can be divided into three general categories. The first is the issuing authority information 14. This includes the generic information that is the same regardless of the person to whom the card 10 is issued and includes for example, the name of the issuing authority, the purpose of the ID, etc. This generic information 14 is maintained within the image file that is printed onto the card 10 and is combined with the other two categories of indicia for printing onto the ID card 10.

The second category of indicia is the biometric information 16 that is specific to each recipient of the ID card 10. This biometric information 16 includes the user's name, address, weight, height, date of birth, picture, signature, etc. and is customized to match the profile of each user to whom an ID card 10 is issued. This information is also included into the overall image to be printed onto the ID card 10.

The final category of indicia printed onto the ID card is the security printing features 18. This component is critical to the present invention. The security indicia 18 of the present invention are printed in predetermined locations on the card 10. The security indicia 18 may be provided as a printed text 20 in a repeating pattern. In addition to being a readable printed text 20 the security indicia 18 may be an encrypted code or machine readable code such as a bar stripe pattern to enhance the security of the card. Other embodiments of the present invention may provide for the security indicia 18 to be placed as an electronically stored code on a magnetic stripe or as covert text that can only be read when the ID card 10 is viewed under a specific wavelength light such as ultra-violet light.

The security printing 20 on the present invention may use a code that appears in a variety of forms. Specifically however, the intent of the present invention in using a code is to provide a means by which the authenticity of the identification card 10 can be verified. The security code 20 on its face may provide sufficient information to an educated viewer of the card 10 to allow them to verify the authenticity. For example, the security personnel in a building may be advised that certain combinations of letters and numbers correspond to certain biometric information 16 on the face of the card 10. As long as the coded information 18 corresponds to the printed information 16 on the face of the ID card 10 then the authenticity of the card 10 is verified. As another example, the security code 20 may be placed in an electronic format on a magnetic stripe in an undisclosed location on the card. When the card is scanned, the code must be included for the card 10 to be valid. If the code 20 does not appear or does not match the code 20 normally found on the type of card 10 in question the card 10 will be identified as counterfeit.

Figure 2:
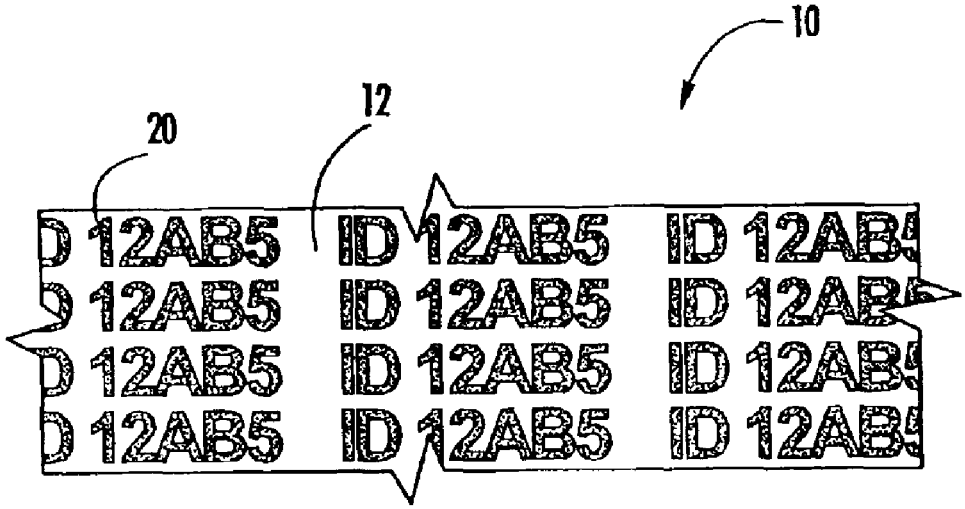
FIG. 2 is a close up view of the security printing thereon.
Figure 3:
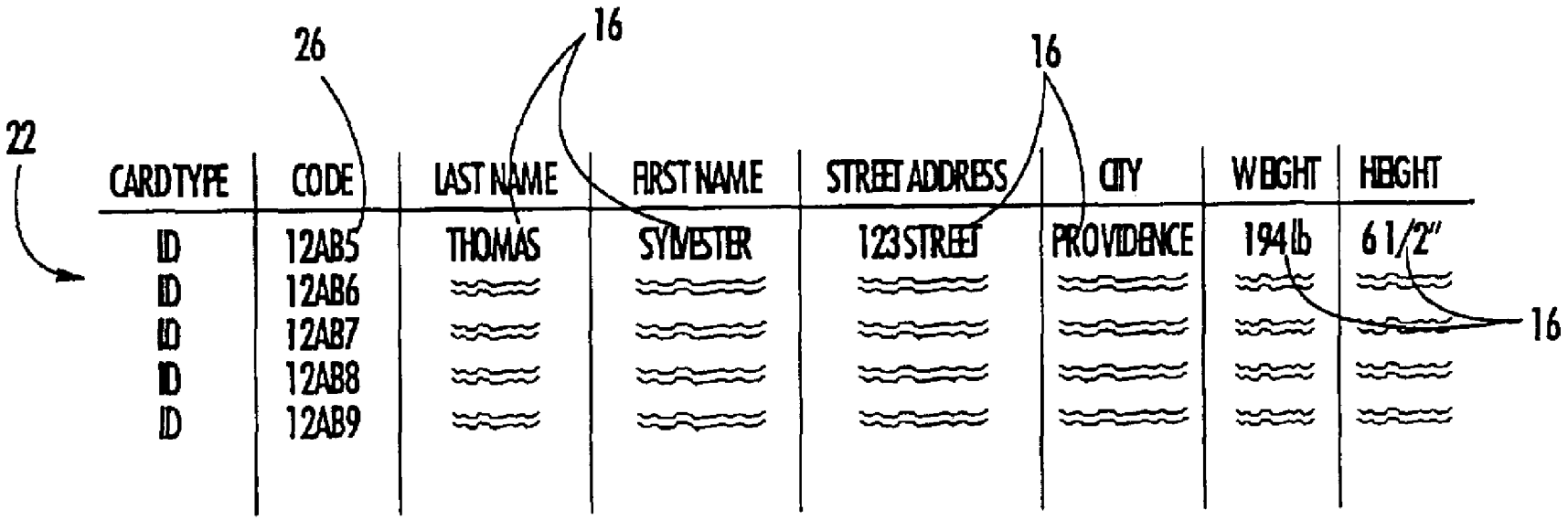
FIG. 3 is a chart showing the database record maintained relating to the issued identification cards.

Turning to FIG. 2, printed security text 18 can be seen. The present invention provides for this text 18 to be a specific code 20 printed on the face of the ID card 10. In the preferred embodiment, for example the code would be a code 20 lifted from the print driver software corresponding to the actual print job-tracking log within the software. FIG. 2 illustrates a sample code text 20. The use of a code 20 provides a further security feature for the present invention. The code 20 is generated at the time and place of card 10 issuance and can be used to verify the authenticity of the ID 10. For example, in generating the code, the issuing authority may have a code arrangement where a specific location code is combined with an issue date and a database record number and printed into the background of the ID card 10. In this manner, the code 20 can be compared to a database or record log of issued ID cards 10 to verify whether the code 20 matches a legally issued ID card 10. This code 20 may vary from issuance location to issuance location or be standardized among state authorities to facilitate training of individuals in the identification of fake ID cards 10. FIG. 4 provides an example of a database entry 22 that corresponds to the security code 20 printed on the ID card 10. In this manner, a separate record is maintained against which the ID card 10 can be cross-referenced and the authenticity thereof verified.

The database containing the authentication records may be maintained by the issuing authority or be centrally maintained. In this manner, a person seeking to verify the authenticity of the identification card 10 can contact the central database to verify the relevant code 20 and information 16 against the discretely maintained record 22. This verification process may be performed in much the same manner as credit card authorizations or ATM transactions are cleared.

The indicia in all of the three above described categories, generic 14, biometric 16 and security 18, are all combined into a single image at the time and place of card issuance and printed onto the card substrate 12 in a single printing operation. The first benefit to producing the cards 10 in this manner is that the raw cards 10 do not have to be pre-printed with the security code 20 printing. This saves on processing costs by eliminating an additional handling and printing step while also reducing the possibility that prepared card stock may be obtained by counterfeiters during the warehousing, shipping or storing of the card stock. In addition, since the security code 20 is produced and recorded at the time the card 10 is printed and is generated and initially stored within the printer log of the issuing authority, it is difficult for a counterfeiter to reproduce an ID card 10 having a properly coded security feature.

The process of the present invention includes the provision of a blank substrate material 12 that is placed into the feeding mechanism of a high precision three-pass thermal printer. An image file is produced that includes the generic issuance information 14, the biometric information of the recipient 16 and the security-code feature 18. The security feature 18 is a code 20 that corresponds to a specific entry in a database record 22 or printer print job log relating to the generation of each individual ID card 10 printed and is generated at the time and place of card issuance. The information is all combined and printed onto the card substrate 12 in one printing operation, thereby producing a finished ID card 10, ready for issuance. The log information 22 may then be stored for future reference by the issuing authority or transferred to a central storage and processing location for widespread access and card authentication. Verification of an ID card 10 would then simply require that the person seeking authentication access the appropriate record 22 using the security code 20 printed on the ID card 10 to verify whether the information 16 on the ID card 10 matched the information contained in the corresponding record 22.

It can therefore be seen that the present invention provides a unique ID card 10 and a method of producing the same that includes an integral security code feature 18 that reduces the ability of a counterfeiter to produce fraudulent ID cards 10. Specifically, the present invention provides for a method of producing an ID card 10 in a single printing operation that reduces the opportunity that raw card stock can be obtained for fraudulent purposes while enhancing the security of the finished product. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An identification card issued by an issuing authority comprising:

a substrate having a front surface; and printed indicia on said front surface of said substrate, said printed indicia including at least one area containing a printed security code, said printed security code being plainly visible but not decipherable by a user, wherein the security code corresponds to an entry made in a database of the printer that prints the security code, the database entry being made at the time the security code is printed on the substrate, the authenticity of said printed indicia capable of being verified by said issuing authority by comparing the database entry with the printed security code.

2. The identification card of claim 1, wherein said security code is a code relating to the time, date and issuance location of the identification card.

3. The identification card of claim 1, wherein security code is a code that corresponds to a discretely identifiable record in a database maintained by said issuing authority, said database record containing information relating to the time, date and issuance of said identification card and information relating to the person to whom said identification card is issued.

4. A method of manufacturing an identification card comprising:

providing a substrate having a front surface;

printing indicia on said front surface of said substrate, said printing indicia including at least one area containing a printed security code, said printed security code being plainly visible but not decipherable by a user; and recording said security code and said printed indicia in a database record at the time the security code and indicia are being printed on the substrate, wherein said security code on said identification card is capable of being compared to said database record to verify the authenticity of said identification card.

5. The method of manufacturing an identification card of claim 4, wherein said security code is a code relating to the time, date and issuance location of the identification card.

6. The method of manufacturing an identification card of claim 5, further comprising the step of:

verifying the authenticity of said identification card by comparing said security code printed on said identification card with said record in said database to verify that said printed indicia on said identification card matches the information contained in said database record.

7. A method of manufacturing an identification card comprising:

providing a substrate having a front surface;

printing indicia on said front surface of said substrate, said printed indicia including at least one area containing a printed security code, said printed security code being plainly visible but not decipherable by a user and another area including biometric information of the identification holder;

recording said security code, said biometric information, the date of issue, the time of issue and the place of issue in a database record as the security code, biometric information, date of issue, and time and place of issue are being printed on the substrate, wherein said security code on said identification card is capable of being compared to said database record allowing said printed indicia on said card to be authenticated; and verifying the authenticity of said identification card by comparing said security code printed on said identification card with said record in said database to verify that said printed indicia on said identification card matches the information contained in said database record.

8. An identification system for authenticating an identification card issued by an issuing authority, said system comprising:

an identification card comprising:

a substrate having a front surface; and printed indicia on said front surface of said substrate, said printed indicia including at least one area containing a printed security code, said printed security code being plainly visible but not decipherable by a user; and a remote database comprising data storage containing a copy of the security code and information associated the stored security code with said identification card, whereby said identification card may be authenticated by comparing the security printed on said substrate with the security code stored in said remote database.

9. The system of claim 8, wherein said security code is a code relating to the time, date and issuance location of the identification card.

10. The system of claim 8, wherein security code is a code that corresponds to a discretely identifiable record in a database maintained by said issuing authority, said database record containing information relating to the time, date and issuance of said identification card and information relating to the person to whom said identification card is issued.

* * * * *